US006206509B1

(12) United States Patent
Lecheheb et al.

(10) Patent No.: US 6,206,509 B1
(45) Date of Patent: Mar. 27, 2001

(54) METHOD AND APPARATUS FOR CONTROLLING A MULTI-NOZZLE INK JET PRINTHEAD

(75) Inventors: Ammar Lecheheb; Jerzy Marcin Zaba, both of Cambridge (GB)

(73) Assignee: Domino Printing Sciences, PLC (GB)

( * ) Notice: Subject to any disclaimer, the term of this patent is extended or adjusted under 35 U.S.C. 154(b) by 0 days.

(21) Appl. No.: 09/331,496

(22) PCT Filed: Dec. 18, 1997

(86) PCT No.: PCT/GB97/03489

§ 371 Date: Aug. 20, 1999

§ 102(e) Date: Aug. 20, 1999

(87) PCT Pub. No.: WO98/28150

PCT Pub. Date: Jul. 2, 1998

(30) Foreign Application Priority Data

Dec. 23, 1996 (GB) ..... 9626706

(51) Int. Cl.[7] ..... B41J 2/12
(52) U.S. Cl. ..... 347/78
(58) Field of Search ..... 347/73–74, 76, 347/78, 80

(56) References Cited

U.S. PATENT DOCUMENTS 4,839,665 * 6/1989 Hertz et al. ..... 347/75

FOREIGN PATENT DOCUMENTS

58158266 * 5/1994 (EP) ..... B41J/3/04
WO 89/02829 * 4/1989 (WO) ..... B41J/3/04
WO 94/11193 * 5/1994 (WO) ..... B41J/2/115

* cited by examiner

*Primary Examiner*—N. Le
*Assistant Examiner*—K. Feggins
(74) *Attorney, Agent, or Firm*—Robert F. I. Conte; Lee, Mann, Smith, McWilliams, Sweeney & Ohlson

(57) ABSTRACT

We provide a method of printing using a multi-nozzle ink jet print head having a pressure modulator for causing streams of ink emitted from the nozzles to be broken up into individual droplets. The nozzles are divided into a plurality of groups of nozzles, and groups of charge electrodes correspond, each group of charge electrodes having a respective charge controller. In the method a modulation waveform is generated to operate the pressure modulator to cause droplets to be generated in each stream. Independently for each group of charge electrodes, the respective charge controller is operated to supply a charge signal waveform to each charge electrode in turn, the phase of the charge signal waveform relative to the modulation waveform is adjusted between 0 and 360 degrees in a number of steps, and the optimum phase relationship to achieve proper charging for each droplet stream is determined in turn. Thereafter the phase of the charge signal waveform relative to the modulation waveform is adjusted to achieve charging of droplets in all the streams in the group simultaneously.

2 Claims, 7 Drawing Sheets

METHOD AND APPARATUS FOR CONTROLLING A MULTI-NOZZLE INK JET PRINTHEAD

FIELD OF THE INVENTION

This invention relates to a method and apparatus for controlling a multi nozzle ink jet printhead.

BACKGROUND OF THE INVENTION

There are two general types of ink jet printing, drop-on-demand (DOD) and continuous (CIJ). Drop-on-demand printing, as its name suggests, produces droplets of ink as and when required in order to print on a substrate. Continuous ink jet printing, to which the present invention relates requires a continuous stream of ink which is broken up into droplets which are then selectively charged; either charged or non-charged droplets are allowed to pass to a substrate for printing, charged droplets being deflected in an electric field either on to the substrate or into a gutter (according to design) where the non-printed droplets are collected for re-use. In the first case, the droplets are deflected by an electric field onto the substrate with the uncharged drops going straight on to be collected in a gutter for re-use. The amount of charge also determines the relative printed position of the drops. In the second case, the droplets are deflected into an offset gutter, with the printing drops being the uncharged ones going straight onto the substrate. The obvious advantage of printing with the uncharged drops is that, in a multi-jet printer where several drop generators are aligned perpendicular to a moving substrate, the alignment of the drops printed on the substrate is not dependent on the ability to accurately and uniformly charge the drops. As long as the charge on the droplets is sufficient for the drops to be deflected into the gutter aperture, small variations in the charge applied will not affect the quality of the resulting print. This second type of printer is generally known as a binary jet printer as the droplets are either charged or uncharged (and do not intentionally carry varying amounts of charge that determine print position).

In typical continuous ink jet printers the printhead has a droplet generator which creates a stream of droplets of ink by applying a pressure modulation waveform to the ink in a cavity in the printhead and the continuous ink stream leaving the printhead breaks up into individual droplets accordingly. This modulation waveform is usually a sinusoidal electrical signal of fixed wavelength. The stream of ink leaving the printhead breaks up into individual drops at a distance (or time) from the printhead commonly known as the break-up point, that is dependent on a n umber of parameters such as ink viscosity, velocity and temperature. Provided these and other factors are kept relatively constant, then a given modulation waveform will produce a consistent break-up length. In order to induce a charge on the droplet, the charging waveform must be applied to the stream at the moment before the drop separates from the stream, and held until the drop is free (ie. must straddle the break-up point). It is therefore necessary to know the phase relationship between the modulating waveform and the actual drop separating from the stream (ie. during which part of the sinusoidal modulation waveform does break-up occur).

One method of determining this phase relationship involves a charge detector (and associated electronics), position somewhere after the charging electrode, which can detect which drops have been successfully charged. A half width charging pulse, progressively advanced by known intervals relative to the modulation waveform, is used to attempt to charge the droplets and the detector output analysed to determine correct charging. Because of the half width pulse, theoretically half the tests should pass and half should fail. The full width pulses used for printing would then be positioned to straddle the detected break-up point. The number of intervals that the waveform is divided into, and therefore the number of possible different phases, can vary from system to system, but usually the timing is derived from a common digital close signal, and therefore is usually a binary power (ie. could be 2, 4, 8, 16, 32 etc.). Typically, 2 and 4 intervals would not give sufficient resolution, and 32 intervals upwards would make the tests too time consuming. Using 16 intervals (ie. 16 different phases) is considered to give more than adequate accuracy without involving a detrimental number of tests.

In a multi-jet print, due to manufacturing tolerances of the nozzles and the characteristics of the (usually common) ink cavity, the break-up point for each of the streams, and therefore the phase setting for printing will be different.

Modern multi-jet printers, in order to be able to print high-quality graphics and true-type scalable fonts, utilise a large number of ink streams, placed very closely together (typically 128 jets at a spacing of 200 microns).

Although it has proved possible to manufacture charge electrodes at the required spacing, to individually charge the streams, it would not be practical to duplicate existing charge electrode driver circuitry 128 times, and so current trends lean towards the use of an integrated driver solution in which a large number of the drive circuits are implemented in one Integrated Circuit device, in order to save space, reduce power etc. With such a device, for practical reasons, it is not possible to enable, or set the level of charging voltage on an individual jet basis, and so all the high voltage drivers within the device have a common enable and common power supply.

Additionally, at present it is not possible to have a separate phase detector for each stream. The probability is that the individual detectors would never be able to isolate the charge from their own stream from the effects of any adjacent streams.

As a final handicap to existing phasing methods being applied to this type of printer, it must be noted that the "normal" condition for the drop stream, ie. not printing, is for all the drops to be charged. Therefore, to test individual jets would require the detection of the non-charged state, resulting in ink being sent to the substrate. Also, the phase detector circuitry would more than likely not be able to distinguish the change in charge passing the detector when a single jet was turned off, against a background of 127 jets still on.

Therefore conventional phase detection methods are not suitable for modern high-resolution binary inkjet printers.

The present invention is directed towards overcoming the above problems.

SUMMARY OF THE INVENTION

According to the present invention there is provided a method for controlling a multi-nozzle ink jet printhead having a pressure modulator for causing streams of ink emitted from the nozzles to be broken up into individual droplets, the nozzles being divided into a plurality of groups of nozzles, and corresponding groups of charge electrodes, each group of charge electrodes having a respective charge controller, the method comprising, generating a modulation waveform to operate the pressure modulator to cause droplets to be generated in each stream; and independently for each group of charge electrodes:

operating the respective charge controller to supply a charge signal waveform to each charge electrode in turn;

adjusting the phase of the charge signal waveform relative to the modulation waveform between 0 and 360 degrees in a number of steps;

determining the optimum phase relationship to achieve proper charging for each droplet stream in turn;

and thereafter adjusting the phase of the charge signal waveform relative to the modulation waveform to achieve charging of droplets in all the streams in the group simultaneously.

Thus, for each group of nozzles/charge electrodes, the phase of the charge signal waveform is adjusted independently of that of the other groups so that proper charging of droplets in all the streams can be achieved.

This 'phasing' method is carried out at start-up of the printer, before printing starts, in order to set the initial phase relationships between waveforms generated by the plural charge controllers and the modulation waveform. The 'printable' droplets generated during this start-up phasing procedure can be collected in the gutter (to avoid unwanted printing) by moving the gutter (as described for example in our EP-A-0780231). Thereafter and during pauses in the printing process, the phasing can be adjusted as described in our British patent application no. 9626707.5 and our co-pending International patent application reference MJB05642WO.

This solution applies itself to the determination of the correct printing phases to be used in a high-resolution multi-jet printer. Establishing that correct phasing of each jet is possible, before starting to print, has additional diagnostic benefits to the system, for instance, establishing the presence of blocked or mis-directed jets. The determination of whether or not droplets are being properly charged is achieved through the use of a phase detector electrode disposed below the charge electrodes and arranged to determine the charge applied to each droplet.

One example of a method according to the present invention will now be described with reference to the accompanying drawings, in which:

DETAILED DESCRIPTION OF THE INVENTION

Figure 1:
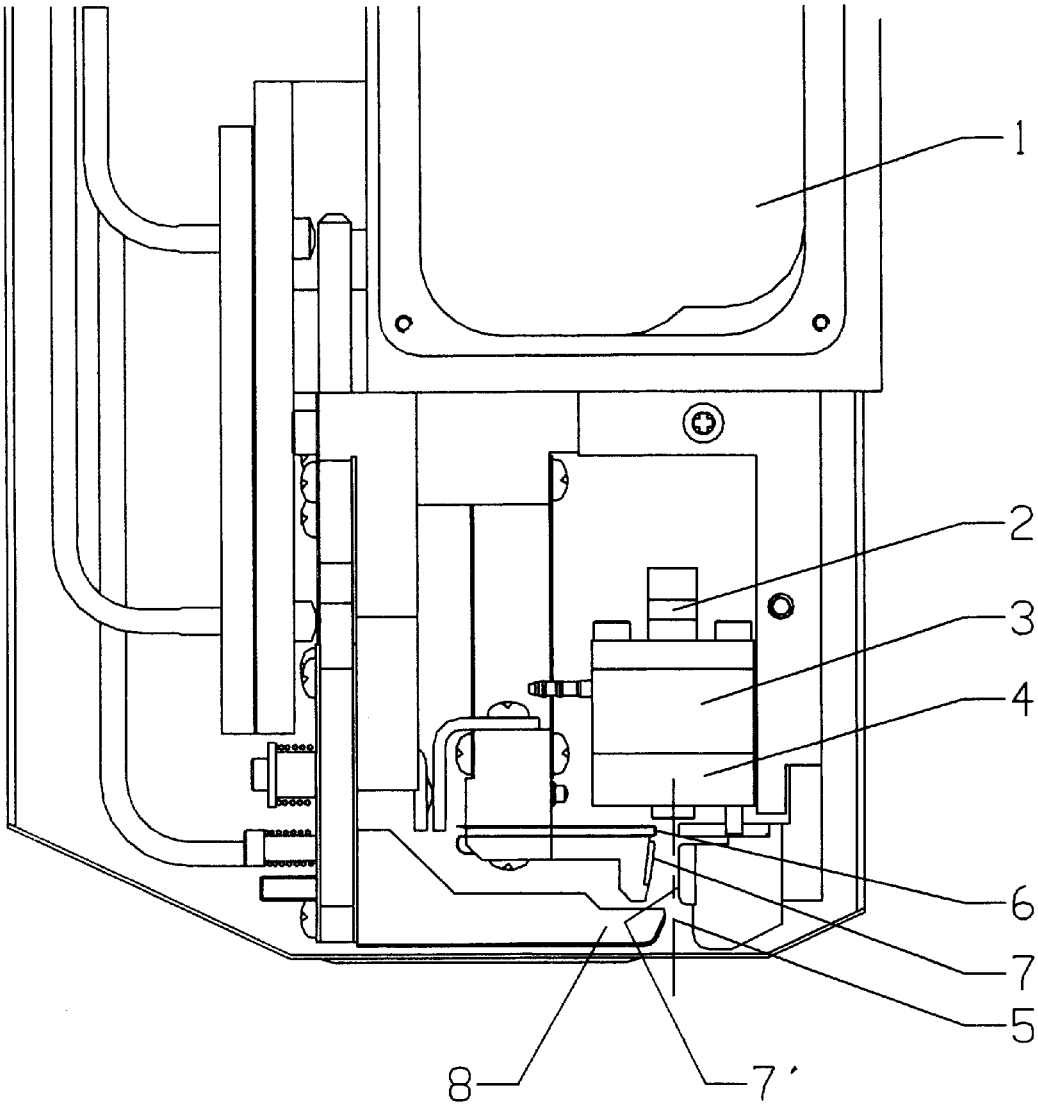
FIG. 1 is a side view of the printhead of a multi-nozzle CIJ printer as described in our EP-A-0780231.

The printhead shown in FIG. 1 is described in more detail in our EP-A-0780231. Since not all the features shown in FIG. 1 are relevant for a description of the present invention only the primary features will be referenced and described.

The printhead has an electronics sub-system 1 by means of which are controlled the piezoelectric oscillator 2 forming part of a droplet generator 3 which has a nozzle plate 4 from which, in use, issue plural streams 5 of ink. The closely spaced nozzles are arranged in a row normal to the plane of the drawing. The streams of ink break up into individual droplets which pass respective charge electrodes 6 also arranged in a row in the same direction, where they are selectively charged and then passed between a pair of deflection electrodes 7, 7' which establish, in use, an electric field by means of which charged droplets are deflected from their straight-line path into a gutter 8. Formed in the face of the deflection electrode 7' is a phase detector electrode (not shown) which is used to detect the charge applied to droplets by the charge electrode 6. The phase detector electrode is described more fully in our British Patent Application no. 9626686.1 and our co-pending International Patent Application reference MJB05548WO.

Figure 3:
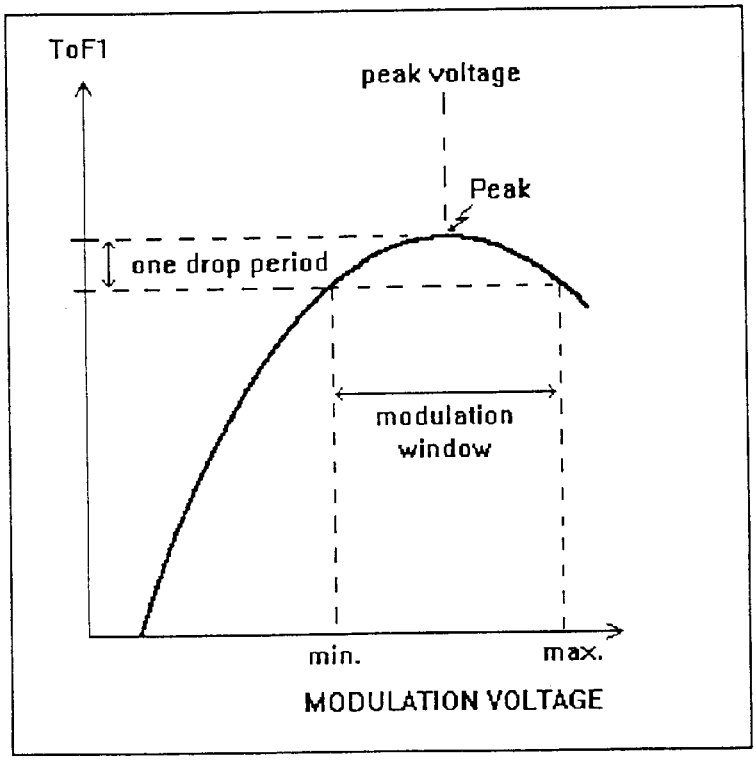
FIG. 3 illustrates a portion of the modulation voltage waveform applied to the droplet generator.
Figure 4:
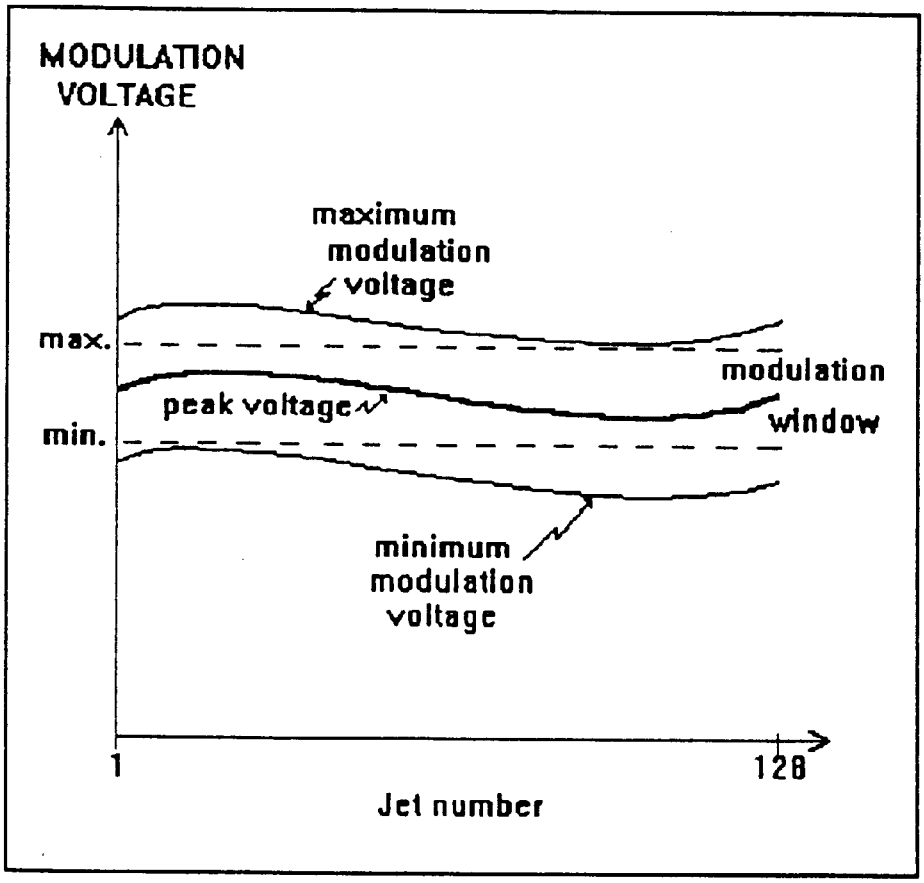
FIG. 4 illustrates an example of how the modulation window varies across the multiple nozzles in the printhead.
Figure 5A:
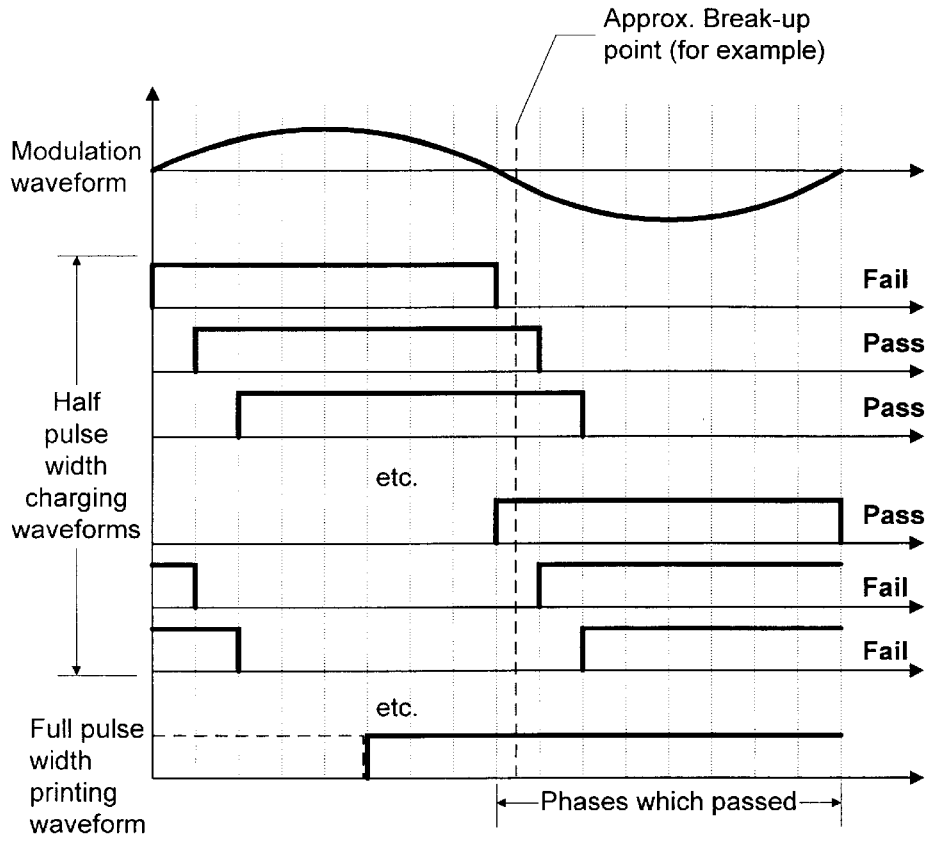
FIG. 5A illustrates examples of the possible spread of phase values.

The modulation waveform applied to the piezoelectric oscillator 2 and used to generate a corresponding pressure modulation within the droplet generator 3 so that the streams 5 of ink break up into droplets, is a sinusoidal electrical signal, part of which is shown in FIG. 3 & FIG. 5A. The amplitude-of the modulation voltage is controlled from the electronics module 1 and can be set by appropriate software. As long as the ink parameters (composition, viscosity, temperature) are kept constant then a defined modulation waveform will produce a consistent drop break off pattern from each nozzle. This means that the time between the zero-point on the waveform and the time when the drop breaks away from the stream will be constant (ie. there is a constant phase relationship between the modulation waveform and the break up point of the ink stream). This fact can be used to set a fixed relationship between the charge waveform applied to the charge electrode 6 and the droplet break up rate. The charge electrode waveform and the modulation waveform are derived from a common system clock within the electronics module 1.

Figure 8:
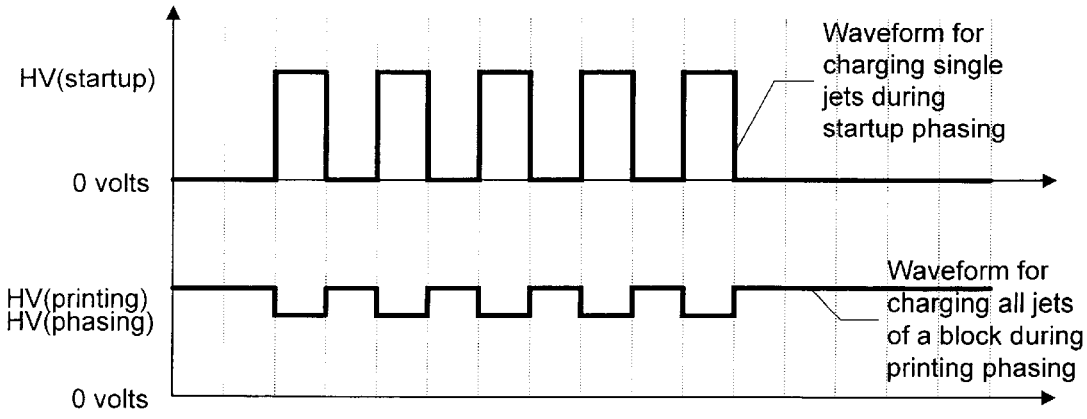
FIG. 8 is an illustration of waveforms suitable for charging single jets during start-up and suitable for charging all jets in a block or group during printing.

For the purposes of printing, the charge controller waveform (see FIGS. 2 & 8) is a digital or square waveform which has a value of 0 volts for droplets which are to be printed and a steady high voltage (in the region of 60–180 volts) for non-printable droplets. The transition between the two voltage values is very rapid (of the order of 0.5 microseconds). The phase of the charge controller waveform determines when the transition occurs between the two voltages.

Droplet charging arises from the fact that there is a small capacitance between the droplet being formed and the charge electrode. A voltage on the charge electrode thus causes a small displacement current to flow in the ink jet which forms a collection of charge on the droplet so that once the droplet has broken away from the stream it carries a charge which cannot change. A steady voltage on the charge electrode produces a continuous stream of charged droplets. In a similar way, 0 volts on the charge electrode 6 does not induce any charge on the droplet. Furthermore, an uncharged droplet cannot acquire any charge once it breaks off the stream so that a steady 0 volts on the charge electrode 6 will produce a stream of uncharged droplets.

Thus it will be appreciated how critical it is to the charging process that the droplet break-up point (determined by the pressure modulation waveform) is properly adjusted. This is described more fully in our co-pending British Patent Application reference MJB05641GB.

During printing the charge electrode voltage has to be switched between 0 volts and the high voltage for a single drop period in order to allow a droplet to be printed. In order to produce a drop with no charge the charge electrode 6 has to be held at 0 volts while the drop breaks off and, ideally, the charge electrode 6 is kept at 0 volts for as long as possible on each side of the break off point. In practice, however, there is a limit to the time for which the charge electrode voltage can be held constant without interfering with the charge on the previous drop or that on the following drop and the optimum point for changing the charge electrode voltage is halfway between the break-off adjacent droplets.

In the printer of this example, to which the method of the present invention is applied, there are 128 nozzles (and a corresponding number of charge electrodes 6) which are, effectively, divided into 8 groups of 16. A single charge electrode controller is used to apply the appropriate charging waveform to each of the 16 charge electrodes in a group and thus 8 of these are provided.

Figure 2:
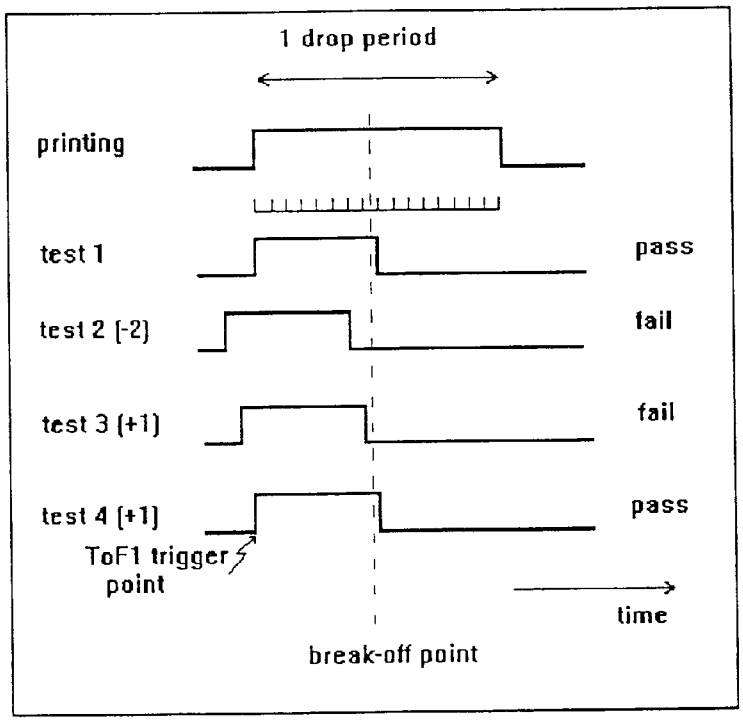
FIG. 2 is a diagram illustrating the process of start-up phasing.

As described above it is convenient to divide each drop period into 16 equal segments which allows the value of the charge electrode phase to have 16 possible values. In order to achieve the correct phasing to set up the printer prior to printing being started it has to be determined which phase value places the break-up point in the middle of the charging pulse. FIG. 2 illustrates this process.

At the top of FIG. 2 there is an indication of the width of a drop period ie. the time between adjacent droplets passing the charge electrode and immediately below that is a representation of the 16 possible phase values. Running down the middle of the figure is a dotted line representing (arbitrarily) the point at which the droplet breaks off. The charge electrode pulse is symmetric about the break up point in a temporal sense.

In order to carry out a phase test as part of the set-up procedure, the charge electrode pulse is reduced in width to exactly half the width of the normal pulse and is known as a half-width pulse. The half-width pulse starts at the same time as the full pulse but finishes halfway (at roughly the drop break-up point). If the break-up point is included within the half-width pulse then a charged drop will be produced which can be detected by the phase detector electrode referred to above and a positive result can be recorded within the electronics module 1. If the break-up point is not included in the half-width pulse then an uncharged drop will be produced and consequently there will be no detection of a charged drop by the phase detector electrode and the software will record a negative result. FIG. 5A illustrates how the half-width pulse can be scanned backwards and forwards across the break-up point in order to establish the position of the break-up point.

In this example of a method according to the invention, each of the 16 charge electrodes in each group has in turn, applied to it, a half-width pulse waveform which provides a series of charging pulses, while the remainder of the charge electrodes in the group have 0 volts applied. By this means, the phase detector electrode which monitors the value of charge applied to the droplets and which is common to all the droplet streams can be used to detect whether charge has been applied or not to the droplets generated in a single stream and thus determine the position of the break-up point relative to the charge controller waveform, ie. the phasing of the break-up point to the charging waveform.

Figure 5B:
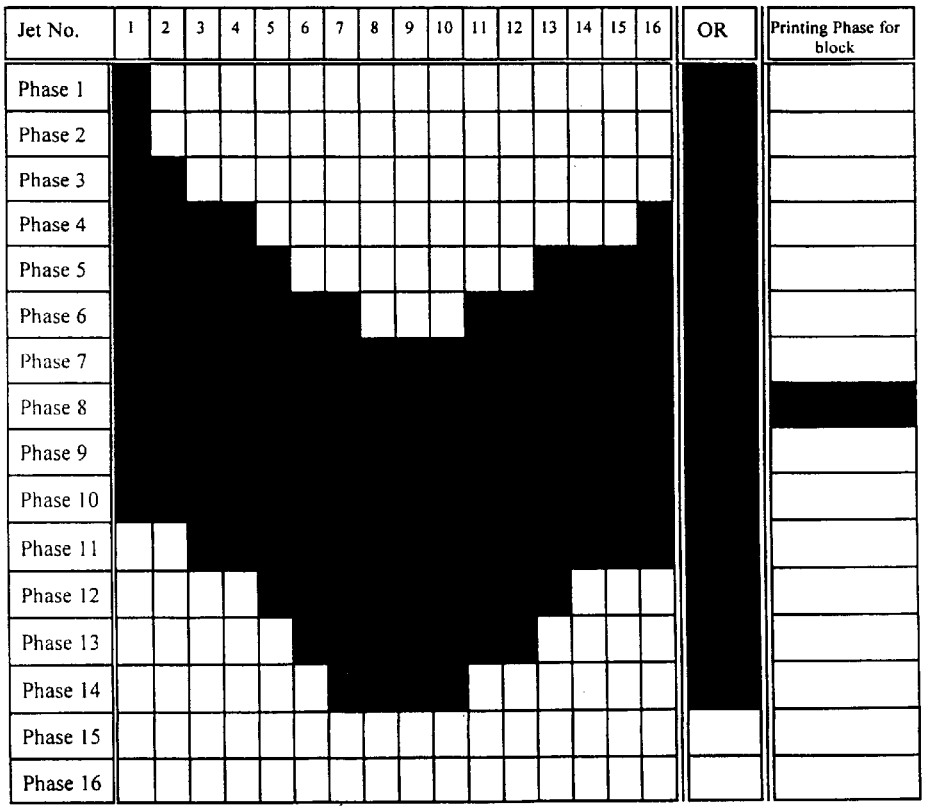
FIG. 5B illustrates an examples of the possible spread of phase values for a complete block or group of jets.

In practice it is found that there is, across the 16 droplet streams in each group, a spread of phase such as that illustrated in FIGS. 5A & 5B, and the charging waveform is adjusted appropriately so that the centre of the spread occurs substantially at the centre of the full width printing pulse of the charging waveform. This is achieved through appropriate software within the electronics module 1.

Figure 6:
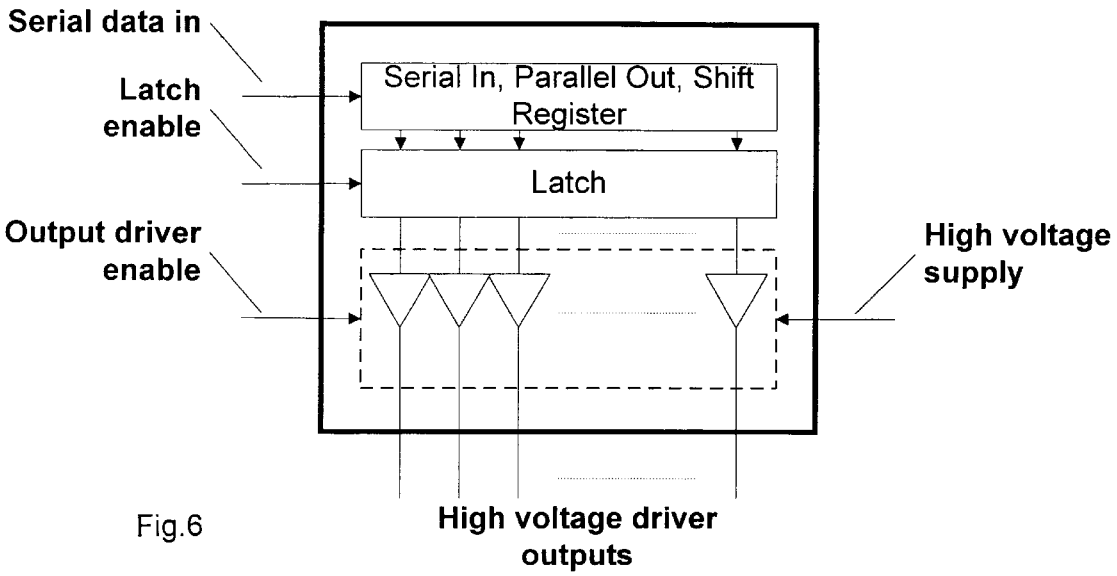
FIG. 6 illustrates the circuitry of a charge electrode controller.

In order to charge the electrodes from a single jet, the controlling electronics and/or software must write approximate printing data to the printhead, prior to executing the phase tests. The data will be such, that only a single jet will be charged ie. will have only 1 bit our of 128 set to 1 (or 0 in the case of negative logic). If the data can be latched or held by the driver circuit (see FIG. 6), the same jet may be tested repeatedly, and at different phases, without the necessity of send more data, until the next jet requires testing. The enable of the driver device is simply pulsed with the phase timing charge signal.

The phase detector can then easily distinguish the phases which word for that jet and those that do not, because for those that do not there will be no charge at all passing the detector, as all the other jets are known to be uncharged.

In this example, where 128 jets are controlled by 8 driver devices (in blocks of 16), and the enables of those devices are individually controllable, the overhead of writing data can be still further reduced. Data can be written across the whole 128 bit width of the array, such that the corresponding bit is set in each block (ie. jets 1, 17, 33 . . . ). Phase tests can now be performed on jet 1 by pulsing only the enable to the device for block 1, jet 17 by pulsing the driver for block 2 etc. In all it would be possible to test 16 jets at all 16 phases, before it would be necessary to write new data.

In order to reduce the effect of an occasional erroneous result (for whatever reason), it is prudent to conduct the same tests a number of times, and taking an average of the results. For instance, test each jet at each phase four times, and only consider a phase as passed if 3 out of 4 (or all 4!) tests passed. Again, the four sets of tests on all phases on all corresponding jets in all blocks, could be completed before it would be necessary to write new data.

In theoretical discussion that preceded, it was stated that because a half width pulse was used for the phase tests, that half of the phases should pass for any given jet, so in this example 8 should pass and 8 should fail. In practice, due to noise considerations, the number of passes may vary from the theoretical 8, but this should not affect the determination that the jet can be correctly phased and at what particular phase. However it should be checked that the phase for which a jet passes to constitute a contiguous group. A suitable algorithm for determining that a jet can be phased satisfactorily is that say between 4 and 12 phases results in passes, and that these are in a contiguous group, ie. passing on phases 2 to 11 represents a satisfactory jet. Passing on phases 2, 4, 6 and 8 to 12 does not, (even though there are 8 passes!).

Figure 7A:
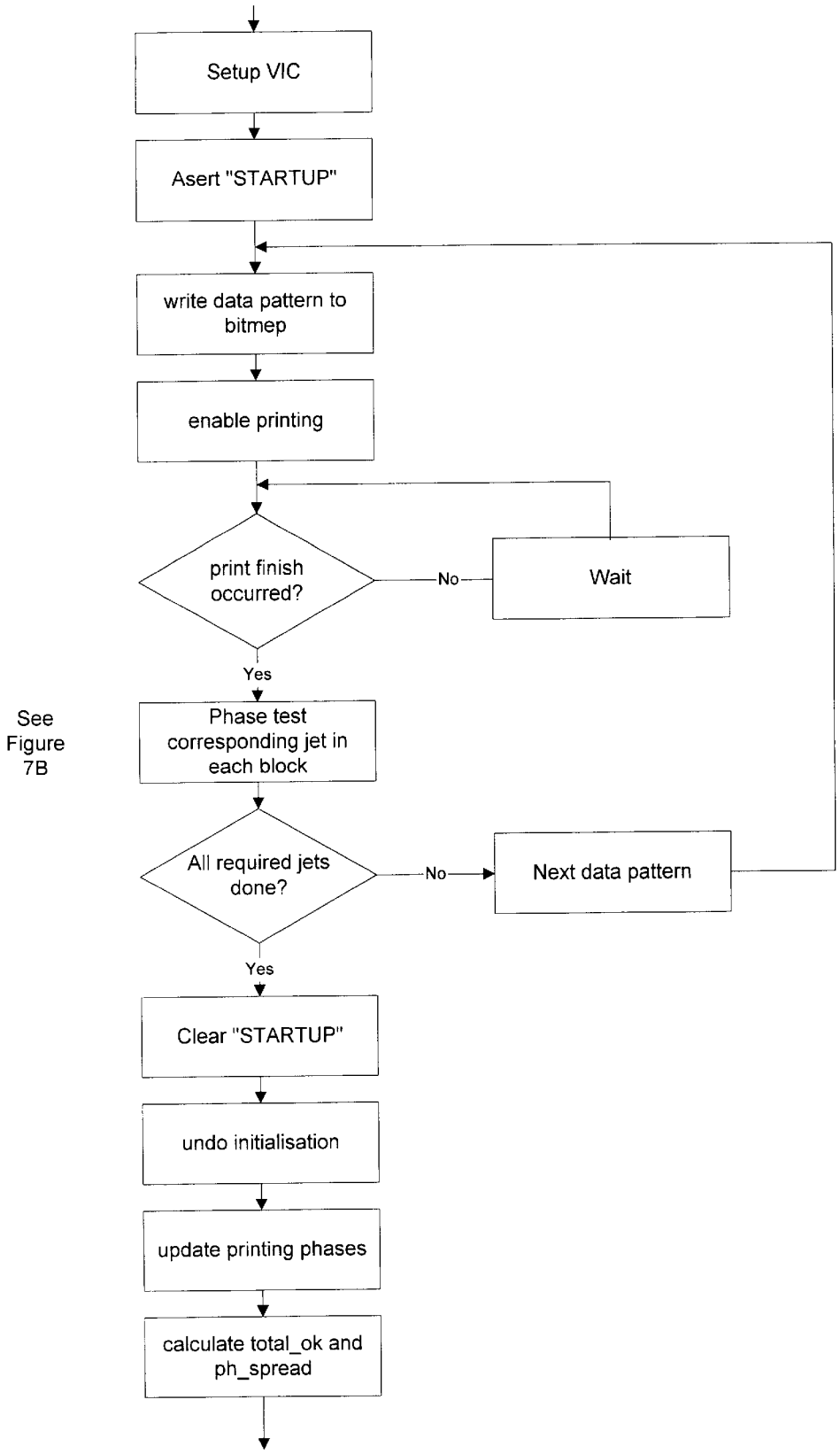
FIGS. 7A & 7B are a flowchart illustrating the phasing procedure according to an example of the present invention; andy
Figure 7B:
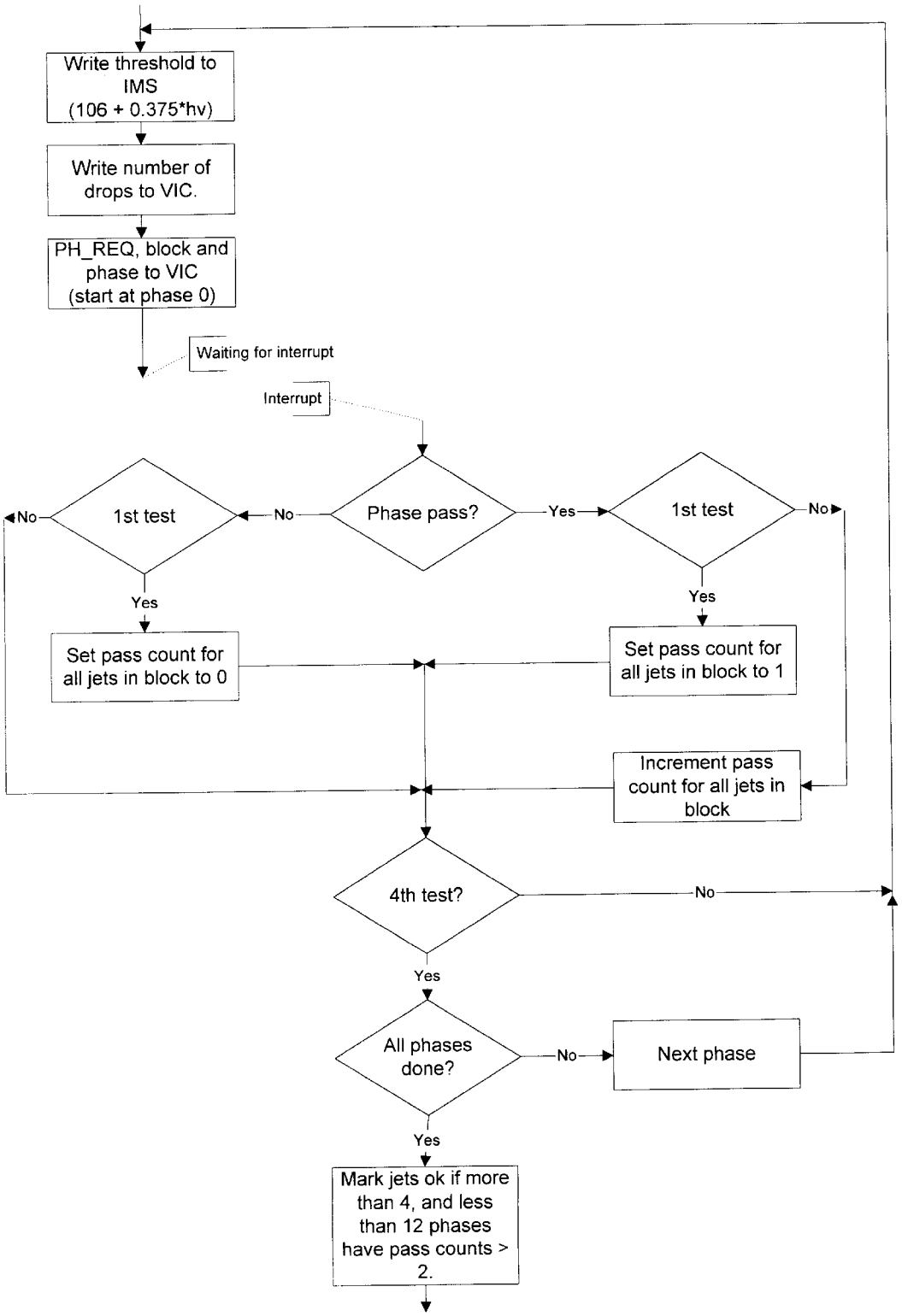

Having obtained a set of passes for a jet and determined that they are both sufficient and contiguous, the correct printing phase for that jet can be calculated, essentially by taking the mean of the phases passed, though in practice an empirically determined offset may be uniformly added. Since each group of 16 droplet streams can be phased in this way, each of the charge controllers can be synchronised to the modulation waveform to achieve accurate registration between drops printed from each of the nozzles. The phasing process is illustrated in more detail in the flowchart of FIGS. 7A & 7B.

Thus, the phasing of the charging waveforms for the 8 groups of charge electrodes can be set up prior to printing commencing.

Additionally, the test results can be analysed to find additional information about the current operational state of the system. For instance, if all jets always fail on all phases, the charge electrode may be badly positioned (in a system with say a retractable charge electrode), the modulation may be incorrectly set (so that the breakup point of all jets is outside the vicinity of the charge electrode) etc. If some jets fail to phase, where most of the jets are alright, these may indicate blocked or misdirected jets.

What is claimed is:

1. A method of printing using a multi-nozzle ink jet print head having a pressure modulator for causing streams of ink emitted from the nozzles to be broken up into individual droplets, comprising, dividing the nozzles into a plurality of groups of nozzles with each group of nozzles having more than one nozzle, providing corresponding groups of charge electrodes, with each group of charge electrodes having a respective charge controller, generating a modulation waveform during the printing to operate the pressure modulator to cause droplets to be generated in each stream; and independently for each group of charge electrodes:

operating the respective charge controller to supply a charge signal waveform to each charge electrode in turn;

adjusting the phase of the charge signal waveform relative to the modulation waveform between 0 and 360 degrees in a number of steps;

determining the optimum phase relationship to achieve proper charging for each droplet stream in turn;

and thereafter adjusting the phase of the charge signal waveform relative to the modulation waveform to achieve charging of droplets in all the streams in the group simultaneously.

2. A multi-nozzle ink jet print head having a plurality of nozzles divided into more than one group of nozzles with each group of nozzles having more than one nozzle;

a pressure modulator for causing streams of ink emitted from the nozzles to be broken up into individual droplets;

more than one group of charge electrodes, each group of charge electrodes having a respective charge controller been positioned for each group of nozzles to supply a charge signal waveform to each charge electrode in turn;

means for generating a pressure modulation waveform applied to said pressure modulator;

means for adjusting the phase of the charge signal waveform relative to the modulation waveform;

means for determining the optimum phase relationship to achieve proper charging for each droplet stream; and said means for adjusting the phase of the charge signal waveform relative to the modulation waveform operating to independently for each group of charge electrodes:

operating the respective charge controller to supply a charge signal waveform to each charge electrode in turn;

adjusting the phase of the charge signal waveform relative to the modulation waveform between 0 and 360 degrees in a number of steps;

determining the optimum phase relationship to achieve proper charging for each droplet stream in turn;

and thereafter adjusting the phase of the charge signal waveform relative to the modulation waveform to achieve charging of droplets in all the streams in the group simultaneously.

* * * * *